US005206507A

United States Patent [19]

Kelley

[11] Patent Number: 5,206,507

[45] Date of Patent: Apr. 27, 1993

[54] MASS SPECTROMETRY METHOD USING FILTERED NOISE SIGNAL

[75] Inventor: Paul E. Kelley, San Jose, Calif.

[73] Assignee: Teledyne MEC, Mountain View, Calif.

[21] Appl. No.: 809,767

[22] Filed: Dec. 18, 1991

Related U.S. Application Data

[63] Continuation-in-part of Ser. No. 753,325, Aug. 30, 1991, which is a continuation-in-part of Ser. No. 662,191, Feb. 28, 1991.

[51] Int. Cl.[5] ..... H01J 49/42

[52] U.S. Cl. ..... 250/282; 250/291; 250/292

[58] Field of Search ..... 250/282, 290, 291, 292

[56] References Cited

U.S. PATENT DOCUMENTS

| | | | |
|---|---|---|---|
| 4,540,884 | 9/1985 | Stafford et al. | 250/282 |
| 4,686,367 | 8/1987 | Louris et al. | 250/290 |
| 4,736,101 | 4/1988 | Syka et al. | 250/292 |
| 4,749,860 | 6/1988 | Kelley et al. | 250/282 |
| 4,761,545 | 8/1988 | Marshall et al. | 250/291 |
| 4,771,172 | 9/1988 | Weber-Grabau et al. | 250/282 |
| 4,818,869 | 4/1989 | Weber-Grabau | 250/282 |
| 4,882,484 | 11/1989 | Franzen et al. | 250/282 |
| 4,975,577 | 12/1990 | Franzen et al. | 250/291 |
| 5,075,547 | 12/1991 | Johnson et al. | 250/292 |
| 5,134,286 | 7/1992 | Kelley | 250/282 |

FOREIGN PATENT DOCUMENTS

| | | |
|---|---|---|
| 0180328 | 5/1986 | European Pat. Off. . |
| 0237268 | 9/1987 | European Pat. Off. . |
| 0336990 | 10/1989 | European Pat. Off. . |
| 0362432 | 4/1990 | European Pat. Off. . |
| 0383961 | 6/1990 | European Pat. Off. . |

OTHER PUBLICATIONS

P. H. Dawson & N. R. Whetten, "Non-Linear Resonances in Quadrupole Mass Spectrometers Due to Imperfect Fields I. The Quadrupole Ion Trap," *J. Mass Spectrometry and Ion Physics*, vol. 2, 1969, pp. 45-59.

Tao-Chin Lin Wang, Tom L. Ricca, and Alan G. Marshall "Extension of Dynamic Range in Fourier-Transform Ion Cyclotron Resonance Mass Spectrometry Via Stored Waveform Inverse Fourier Transform Excitation", Anal. Chem. 1986, 58, 2935-2938.

*Primary Examiner*—Jack I. Berman

*Attorney, Agent, or Firm*—Limbach & Limbach

[57] ABSTRACT

A mass spectrometry method in which a trapping field signal (such as a three-dimensional quadrupole trapping field signal or other multipole trapping field signal) set to store ions of interest is superimposed with a notch-filtered broadband ("filtered noise") signal, and ions are formed or injected in the resulting combined field. The filtered noise signal resonates all ions (except selected ones of the ions) from the combined field, so that only selected ones of the ions remain trapped in the combined field. The combined filtered noise and trapping field signal (the "combined signal") is then changed to excite the trapped ions sequentially, so that the excited ions can be detected sequentially. The invention can be applied to perform an $(MS)^n$ or CI, or combined $CI/(MS)^n$, mass spectrometry operation.

40 Claims, 3 Drawing Sheets

AXIAL FILTERED NOISE SPECTRUM

MASS SPECTROMETRY METHOD USING FILTERED NOISE SIGNAL

CROSS-REFERENCE TO RELATED APPLICATION

The present application is a continuation-in-part of pending U.S. patent application Ser. No. 07/753,325, filed Aug. 30, 1991, which is itself a continuation-in-part of U.S. patent application Ser. No. 07/662,191, filed Feb. 28, 1991. The text of both these pending applications is incorporated herein by reference.

FIELD OF THE INVENTION

The invention relates to mass spectrometry methods in which ions are selectively trapped within an ion trap, and the trapped ions are then sequentially detected. More particularly, the invention is a mass spectrometry method in which a notch-filtered broadband signal is applied to an ion trap while ions are selectively trapped within the trap, and the trapped ions are then sequentially detected.

BACKGROUND OF THE INVENTION

In a class of conventional mass spectrometry techniques known as "MS/MS" methods, ions (known as "parent ions") having mass-to-charge ratio within a selected range are isolated in an ion trap. The trapped parent ions are then allowed, or induced, to dissociate (for example, by colliding with background gas molecules within the trap) to produce ions known as "daughter ions." The daughter ions are then ejected from the trap and detected.

For example, U.S. Pat. No. 4,736,101, issued Apr. 5, 1988, to Syka, et al., discloses an MS/MS method in which ions (having a mass-to-charge ratio within a predetermined range) are trapped within a three-dimensional quadrupole trapping field. The trapping field is then scanned to eject unwanted parent ions (ions other than parent ions having a desired mass-to-charge ratio) consecutively from the trap. The trapping field is then changed again to become capable of storing daughter ions of interest. The trapped parent ions are then induced to dissociate to produce daughter ions, and the daughter ions are ejected consecutively (sequentially by m/z) from the trap for detection.

In order to eject unwanted parent ions from the trap prior to parent ion dissociation, U.S. Pat. No. 4,736,101 teaches that the trapping field should be scanned by sweeping the amplitude of the fundamental voltage which defines the trapping field.

U.S. Pat. No. 4,736,101 also teaches that a supplemental AC field can be applied to the trap during the period in which the parent ions undergo dissociation, in order to promote the dissociation process (see column 5, lines 43–62), or to eject a particular ion from the trap so that the ejected ion will not be detected during subsequent ejection and detection of sample ions (see column 4, line 60, through column 5, line 6).

U.S Pat. No. 4,736,101 also suggests (at column 5, lines 7–12) that a supplemental AC field could be applied to the trap during an initial ionization period, to eject a particular ion (especially an ion that would otherwise be present in large quantities) that would otherwise interfere with the study of other (less common) ions of interest.

U.S. Pat. No. 4,686,367, issued Aug. 11, 1987, to Louris, et al., discloses another conventional mass spectrometry technique, known as a chemical ionization or "CI" method, in which stored reagent ions are allowed to react with analyte molecules in a quadrupole ion trap. The trapping field is then scanned to eject product ions which result from the reaction, and the ejected product ions are detected.

European Patent Application 362,432 (published Apr. 11, 1990) discloses (for example, at column 3, line 56 through column 4, line 3) that a broad frequency band signal ("broadband signal") can be applied to the end electrodes of a quadrupole ion trap to simultaneously resonate all unwanted ions out of the trap (through the end electrodes) during a sample ion storage step. EPA 362,432 teaches that the broadband signal can be applied to eliminate unwanted primary ions as a preliminary step to a CI operation, and that the amplitude of the broadband signal should be in the range from about 0.1 volts to 100 volts.

SUMMARY OF THE INVENTION

The invention is a mass spectrometry method in which a trapping field signal (such as a three-dimensional quadrupole trapping field signal, or other multipole trapping field signal) set to store ions of interest is superimposed with a notch-filtered broadband signal (denoted herein as a "filtered noise" signal), and ions are formed or injected in the resulting combined field. The filtered noise signal resonates all ions (except selected ones of the ions) from the combined field, so that only selected ones of the ions remain trapped in the combined field.

In a class of preferred embodiments, the combined filtered noise and trapping field signal (the "combined signal") is then changed to excite the trapped ions sequentially, to enable sequential detection of the excited ions.

In another class of embodiments, the filtered noise signal is turned off after resonating undesired ions from the combined field, and one or more parameters of the trapping field signal are then changed to excite the trapped ions sequentially, to enable sequential detection of the excited ions. For example, in the case that the trapping field signal establishes a three-dimensional quadrupole trapping field and includes a DC voltage component, the amplitude of the DC component can be swept (after the filtered noise signal has been turned off) to excite trapped ions sequentially.

DETAILED DESCRIPTION OF THE PREFERRED EMBODIMENTS

Figure 1:
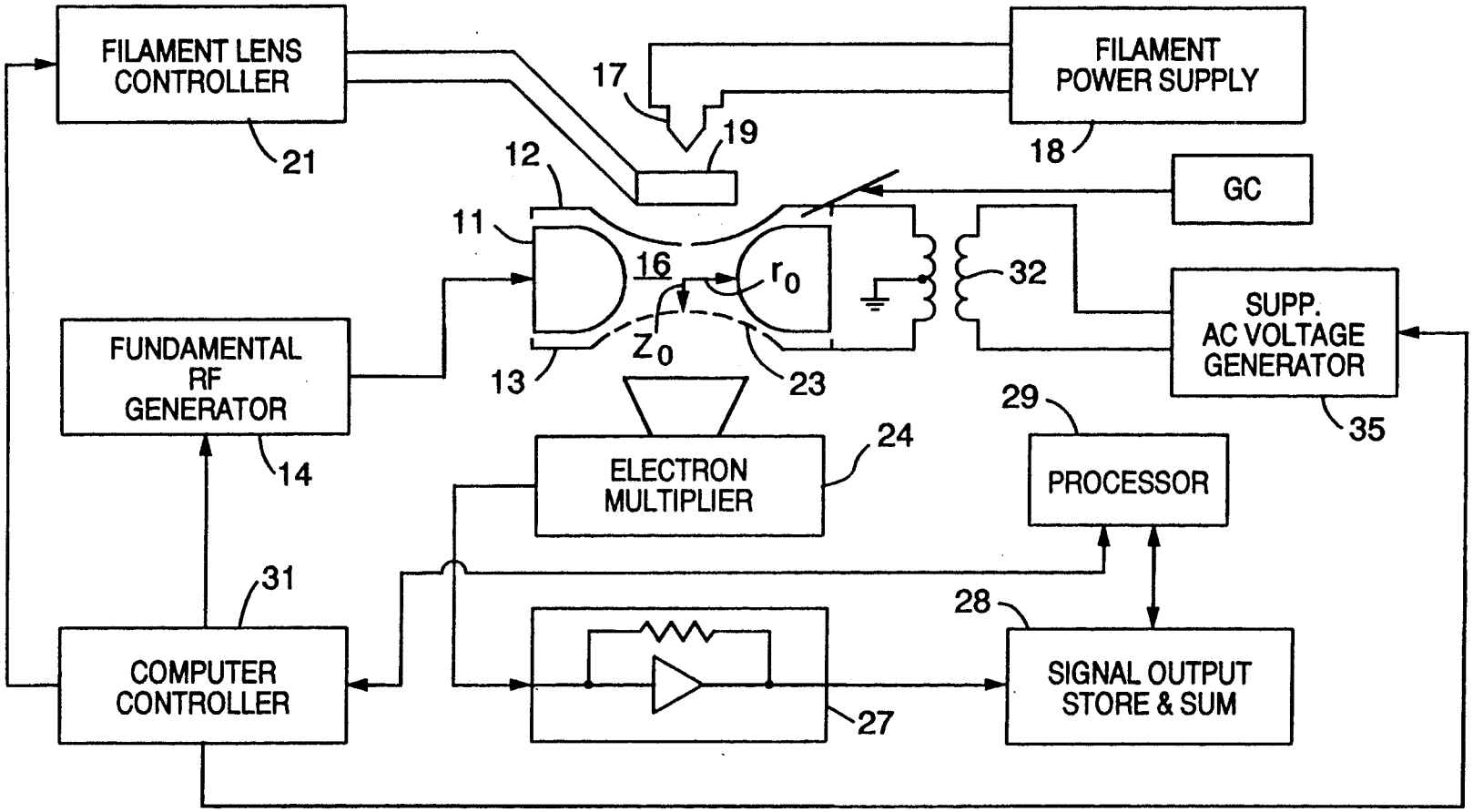
FIG. 1 is a simplified schematic diagram of an apparatus useful for implementing a class of preferred embodiments of the invention.

The quadrupole ion trap apparatus shown in FIG. 1 is useful for implementing a class of preferred embodiments of the invention. The FIG. 1 apparatus includes ring electrode 11 and end electrodes 12 and 13. A three-dimensional quadrupole trapping field is produced in region 16 enclosed by electrodes 11–13, when fundamental voltage generator 14 is switched on to apply a fundamental RF voltage (having a radio frequency component and optionally also a DC component) between electrode 11 and electrodes 12 and 13. Ion storage region 16 has radius $r_o$ and vertical dimension $z_o$. Electrodes 11, 12, and 13 are common mode grounded through coupling transformer 32.

Supplemental AC voltage generator 35 can be switched on to apply a desired supplemental AC voltage signal to electrode 11 or to one or both of end electrodes 12 and 13 (or electrode 11 and one or both of electrodes 12 and 13). The supplemental AC voltage signal is selected (in a manner to be explained below in detail) to resonate desired trapped ions at their axial (or radial) resonance frequencies.

Filament 17, when powered by filament power supply 18, directs an ionizing electron beam into region 16 through an aperture in end electrode 12. The electron beam ionizes sample molecules within region 16, so that the resulting ions can be trapped within region 16 by the quadrupole trapping field. Cylindrical gate electrode and lens 19 is controlled by filament lens control circuit 21 to gate the electron beam off and on as desired.

In one embodiment, end electrode 13 has perforations 23 through which ions can be ejected from region 16 for detection by an externally positioned electron multiplier detector 24. Electrometer 27 receives the current signal asserted at the output of detector 24, and converts it to a voltage signal, which is summed and stored within circuit 28, for processing within processor 29.

In a variation on the FIG. 1 apparatus, perforations 23 are omitted, and an in-trap detector is substituted. Such an in-trap detector can comprise the trap's end electrodes themselves. For example, one or both of the end electrodes could be composed of (or partially composed of) phosphorescent material (which emits photons in response to incidence of ions at one of its surfaces). In another class of embodiments, the in-trap ion detector is distinct from the end electrodes, but is mounted integrally with one or both of them (so as to detect ions that strike the end electrodes without introducing significant distortions in the shape of the end electrode surfaces which face region 16). One example of this type of in-trap ion detector is a Faraday effect detector in which an electrically isolated conductive pin is mounted with its tip flush with an end electrode surface (preferably at a location along the z-axis in the center of end electrode 13). Alternatively, other kinds of in-trap ion detectors can be employed, such as ion detectors which do not require that ions directly strike them to be detected (examples of this latter type of detector, which shall be denoted herein as an "in-situ detector," include resonant power absorption detection means, and image current detection means).

The output of each in-trap detector is supplied through appropriate detector electronics to processor 29.

A supplemental AC signal of sufficient power can be applied to the ring electrode (rather than to the end electrodes) to resonate unwanted ions in radial directions (i.e., radially toward ring electrode 11) rather than in the z-direction. Application of a high power supplemental signal to the trap in this manner to resonate unwanted ions out of the trap in radial directions before detecting ions using a detector mounted along the z-axis can significantly increase the operating lifetime of the ion detector, by avoiding saturation of the detector during application of the supplemental signal.

Preferably, the trapping field has a DC component selected so that the trapping field has both a high frequency and low frequency cutoff, and is incapable of trapping ions with resonant frequency below the low frequency cutoff or above the high frequency cutoff. Application of a filtered noise signal (of the type to be described below with reference to FIG. 3) to such a trapping field is functionally equivalent to filtration of the trapped ions through a notched bandpass filter having such high and low frequency cutoffs.

Control circuit 31 generates control signals for controlling fundamental voltage generator 14, filament control circuit 21, and supplemental AC voltage generator 35. Circuit 31 sends control signals to circuits 14, 21, and 35 in response to commands it receives from processor 29, and sends data to processor 29 in response to requests from processor 29.

Control circuit 31 preferably includes a digital processor or analog circuit, of the type which can rapidly create and control the frequency-amplitude spectrum of each supplemental voltage signal (and/or filtered noise signal) asserted by supplemental AC voltage generator 35 (or a suitable digital signal processor or analog circuit can be implemented within generator 35). A digital processor suitable for this purpose can be selected from commercially available models. Use of a digital signal processor permits rapid generation of a sequence of supplemental voltage signals (and/or filtered noise signals) having different frequency-amplitude spectra (including those to be described below with reference to FIGS. 3 and 4).

Figure 2:
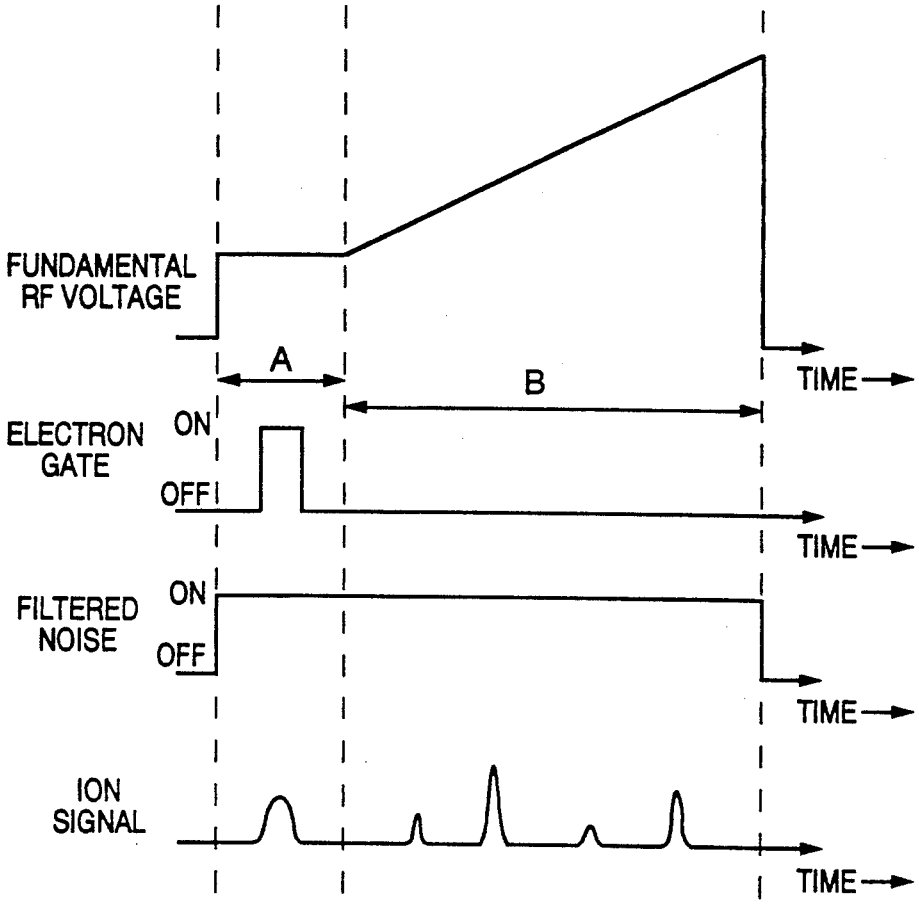
FIG. 2 is a diagram representing signals generated during performance of a preferred embodiment of the invention.

A first preferred embodiment of the inventive method will next be described with reference to FIG. 2. As indicated in FIG. 2, the first step of this method (which occurs during period "A") is to store ions in a trap. This can be accomplished by applying a fundamental voltage signal to the trap (by activating generator 14 of the FIG. 1 apparatus) to establish a quadrupole trapping field, and introducing an ionizing electron beam into ion storage region 16. Alternatively, ions can be externally produced and then injected (typically through lenses) into storage region 16.

The fundamental voltage signal is chosen so that the trapping field will store (within region 16) ions having mass-to-charge ratio within a desired range.

Also during step A, a notch-filtered broadband signal (identified in FIG. 2 as the "filtered noise" signal) is applied to the trap to resonate from the storage region all of the ions formed or injected into the storage region, except one or more selected ions, each having a resonant frequency corresponding to a "notch" of the filtered noise signal. As a result, only the selected ions remain trapped in the "combined field" produced in the storage region by the combined notch-filtered broadband signal and three-dimensional quadrupole trapping field signal (the "combined signal"). Before the end of period A, any ionizing electron beam propagating into the storage region is gated off.

Then, during step "B," the combined signal is changed to excite the trapped ions sequentially, thereby permitting sequential detection of the excited trapped ions. For example (as indicated in the top graph in FIG. 2), the amplitude of the fundamental voltage signal (i.e., the amplitude of an AC or DC component thereof, or of both such components) can be ramped to excite trapped ions sequentially for detection. The trapped ions can be excited non-consecutive mass-to-charge ratio order (for example, by performing any of the techniques explained in applicant's co-pending U.S. Pat. application Ser. No. 07/698,313, filed May 10, 1991, now U.S. Pat. No. 5,173,604) or in consecutive mass-to-charge ratio order (as in the FIG. 2 embodiment).

By changing the combined field parameters (i.e., by changing one or more of the frequency or amplitude of the AC component of the fundamental voltage signal, or the amplitude of the DC component of the fundamental voltage signal), the frequency at which each trapped ion moves in the trapping field is correspondingly changed, and the frequencies of different trapped ions can be caused to match a frequency of a frequency component of the filtered noise signal.

During period A or period B (or both), a supplemental AC voltage (having frequency different than that of the RF component of the fundamental voltage) can be applied together with the fundamental voltage signal. In this case, during period B, the combined field parameters can be changed by changing one or more of the frequency or amplitude of the AC component of the fundamental voltage or supplemental AC voltage, or the amplitude of the DC component of the fundamental voltage.

Figure 3:
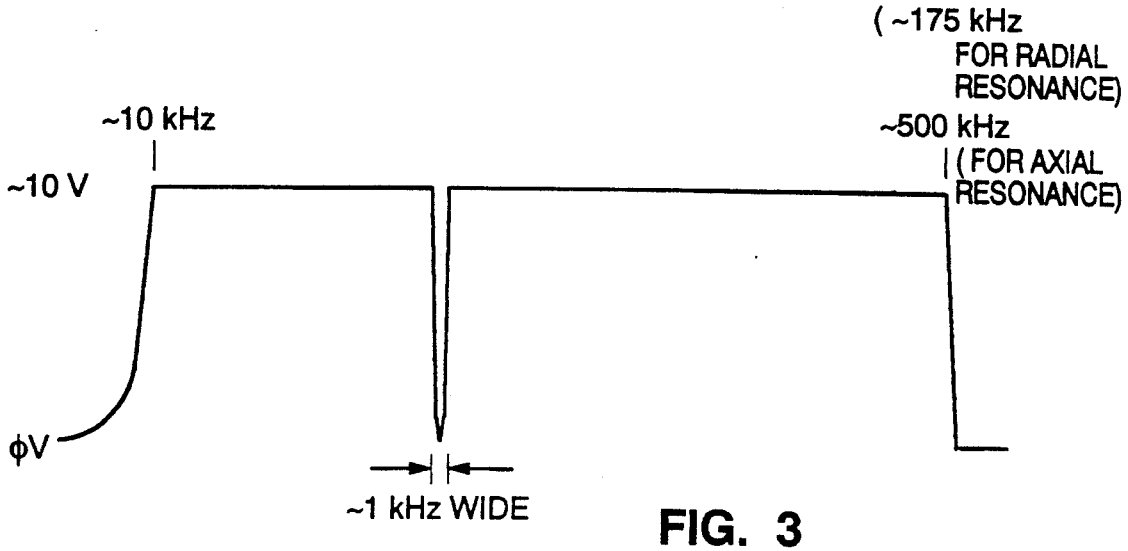
FIG. 3 is a graph representing a preferred embodiment of a notch-filtered broadband signal applied during performance of the invention.
Figure 4:
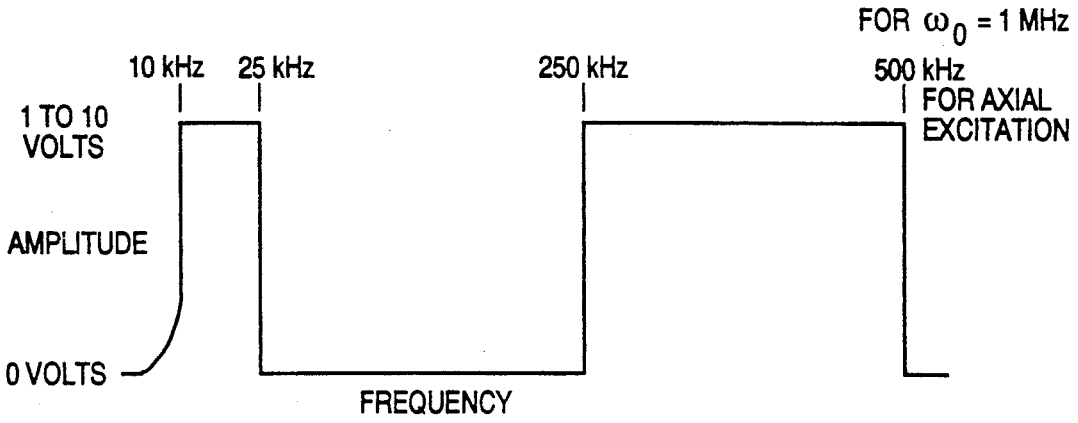
FIG. 4 is a graph representing a second preferred embodiment of a notch-filtered broadband signal applied during performance of the invention.

In preferred embodiments of the invention, the applied filtered noise signal can have the frequency-amplitude spectrum of the signal of FIG. 3 or 4.

The filtered noise signal of FIG. 3 is intended for use in the case that the RF component of the fundamental voltage signal applied to ring electrode 11 during step A has a frequency of 1.0 MHz, when the fundamental voltage signal has a non-optimal DC component (for example, no DC component at all). The phrase "optimal DC component" will be explained below. As indicated in FIG. 3, the bandwidth of the filtered noise signal of FIG. 3 extends from about 10 kHz to about 500 kHz for axial resonance and from about 10 kHz to about 175 kHz for radial resonance (components of increasing frequency correspond to ions of decreasing mass-to-charge ratio). There is a notch (having width approximately equal to 1 kHz) in the filtered noise signal at a frequency (between 10 kHz and 500 kHz) corresponding to the axial resonance frequency of a particular ion to be stored in the trap.

Alternatively, the filtered noise signal can have a notch corresponding to the radial resonance frequency of an ion of interest to be stored in the trap. This is useful in a class of embodiments in which the filtered noise signal is applied to the ring electrode of a quadrupole ion trap rather than to the end electrodes of such a trap. Also alternatively, the filtered noise signal can have two or more notches, each corresponding to the resonance frequency (axial or radial) of a different ion to be stored in the trap.

The characteristics of the filtered noise signal applied during period A can be different than those of the filtered noise signal applied during period B.

The filtered noise signal of FIG. 4 is also intended for use in the case that the RF component of the fundamental voltage signal applied to ring electrode 11 during step A has a frequency of 1.0 MHz. As indicated in FIG. 4, the bandwidth of the filtered noise signal of FIG. 4 extends from about 10 kHz to about 500 kHz for axial resonance. There is a wide notch (having width approximately equal to 225 kHz) in the filtered noise signal at the frequency range between 25 kHz and 250 kHz). Because its notch spans a wide frequency range, the signal of FIG. 4 is useful for trapping several types of ions, having resonant frequencies in a wide frequency band.

Ions produced in (or injected into) trap region 16 during period A, which have a resonant frequency within the frequency range of a notch of the filtered noise signal, will remain in the trap at the end of period A (because they will not be resonated out of the trap by the filtered noise signal), provided that their mass-to-charge ratios are within the range which can be stably trapped by the trapping field produced by the fundamental voltage signal during period A. By applying appropriate filtered noise and fundamental voltage signals, ions in either a contiguous range or one or more noncontiguous ranges of mass-to-charge ratios can be trapped during period A.

To perform $(MS)^n$ mass analysis in accordance with the invention, the filtered noise signal has a notch located at the resonant frequency (or frequencies) of each parent ion to be dissociated. Similarly, to perform CI analysis in accordance with the invention, the filtered noise signal has a notch located at the resonant frequency (or frequencies) of each reagent or reagent precursor ion to be trapped.

In the case that the fundamental voltage signal has an optimal DC component (i.e., a DC component chosen to establish both a desired low frequency cutoff and a desired high frequency cutoff for the trapping field), a filtered noise signal with a narrower frequency bandwidth than that shown in FIG. 3 can be employed. Such a narrower bandwidth filtered noise signal is adequate (assuming an optimal DC component is applied) since ions having mass-to-charge ratio above the maximum mass-to-charge ratio which corresponds to the low frequency cutoff will not have stable trajectories within the trap region, and thus will escape the trap even without application of any filtered noise signal. A filtered noise signal having a minimum frequency component substantially above 10 kHz (for example, 100 kHz) will typically be adequate to resonate unwanted parent ions from the trap, if the fundamental voltage signal has an optimal DC component.

Variations on the FIG. 2 method include the steps of integrating the detected target ion signal, and processing the integrated target ion signal (in a manner that will be apparent to those of ordinary skill in the art) to determine one or more optimizing parameters, such as an "optimum+ ionization time or both an "optimum" ionization time and an "optimum" ionization current, needed to store an optimal number (i.e., optimal density) of target ions (during period A) to maximize the system's sensitivity during target ion detection. Application of the optimizing parameters during a subsequent target ion storage step (period A) should ideally result in storage of just enough target ions to maximize the system's sensitivity during a target ion detection operation. The method could also be used for unknown analysis by resonating (for detection) ions in a range (or ranges) of mass-to-charge ratios preliminary to the mass analysis portion of the experiment (period B). The sensitivity maximization technique described in this paragraph can be applied in a variety of contexts. For example, it can be performed as a preliminary procedure at the start of an $(MS)^n$ or CI, or combined $CI/(MS)^n$, mass spectrometry operation.

In other variations on the inventive method, mass analysis during period B is accomplished using sum resonance scanning or mass selective instability scanning. The ions excited during period B can be detected either by a detector mounted outside the trap, or by an in-trap detector.

In additional variations on the inventive method, the fundamental trapping voltage can establish a multipole trapping field of higher order than quadrupole (such as a hexapole or octapole), or an inharmonic trapping field (rather than a harmonic trapping field). The filtered noise signal can be applied to one or both of the end electrodes of a quadrupole trap, or to the ring electrode of a quadrupole trap, or to some combination of such electrodes. Mass resolution can be controlled by controlling the rate of change of the combined field parameters during the mass analysis step (during period B), or during the trapping step (during period A), or both.

Either a single ion species of interest, or many ion species of interest, can be trapped during period A or mass analyzed during period B.

Figure 5:
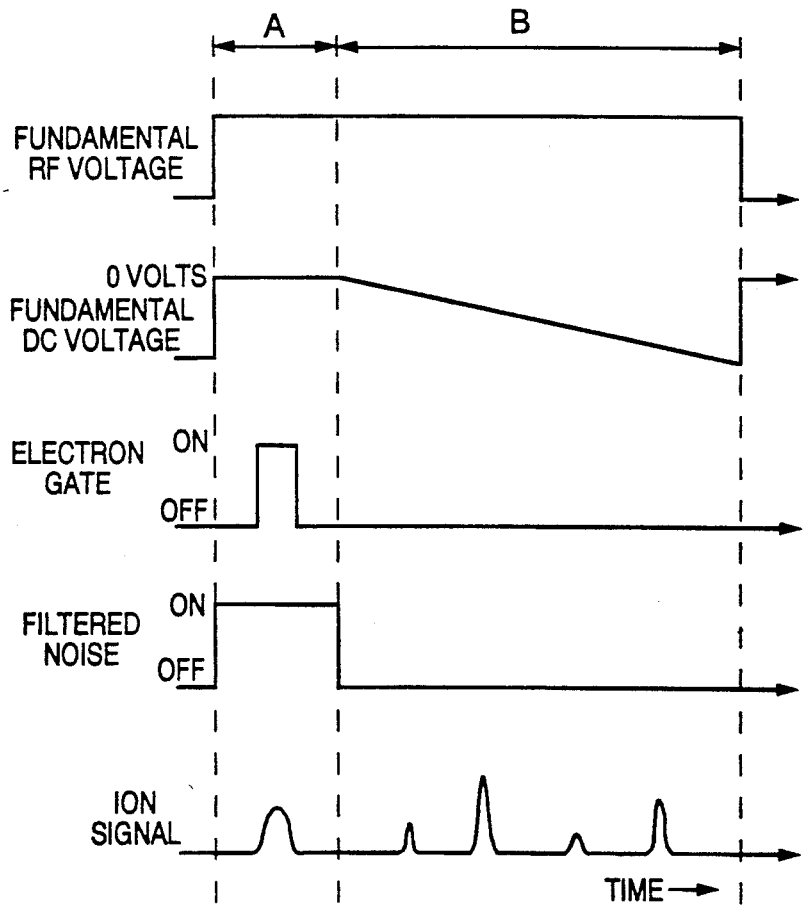
FIG. 5 is a diagram representing signals generated during performance of an alternative embodiment of the invention.

An alternative embodiment of the inventive method will next be described with reference to FIG. 5. As indicated in FIG. 5, the first step of this method (which occurs during period "A") is to store ions in a trap. This can be accomplished by applying a fundamental voltage signal to the trap (by activating generator 14 of the FIG. 1 apparatus) to establish a quadrupole trapping field, and introducing an ionizing electron beam into ion storage region 16. Alternatively, ions can be externally produced and then injected (typically through lenses) into storage region 16.

The fundamental voltage signal can have an RF component, or both an RF component and a DC component, and is chosen so that the trapping field will store (within region 16) ions having mass-to-charge ratio within a desired range.

Also during step A, a notch-filtered broadband signal (identified in FIG. 5 as the "filtered noise" signal) is applied to the trap to resonate from the storage region all of the ions formed or injected into the storage region, except one or more selected ions, each having a resonant frequency corresponding to a "notch" of the filtered noise signal. As a result, only the selected ions remain trapped in the "combined field" produced in the storage region by the combined notch-filtered broadband signal and three-dimensional quadrupole trapping field signal (the "combined signal"). Before the end of period A, any ionizing electron beam propagating into the storage region is gated off.

At the end of period A (in the FIG. 5 method), the filtered noise signal is switched off.

Then, during step "B," the fundamental voltage signal is changed to excite the trapped ions sequentially, thereby permitting sequential detection of the excited trapped ions. For example (as indicated in FIG. 5, in the second graph from the top), the amplitude of a DC component of the fundamental voltage signal can be ramped to excite trapped ions sequentially for detection. ALternatively, the amplitude of an AC component of the fundamental voltage signal, or of both AC and DC components of the fundamental voltage signal, can be ramped to excite trapped ions sequentially for detection. The trapped ions can be excited non-consecutive mass-to-charge ratio order (for example, by performing any of the techniques explained in applicant's co-pending U.S. patent application Ser. No. 07/698,313, filed May 10, 1991, now U.S. Pat. No. 5,173,604 the specification of which is incorporated herein by reference) or in consecutive mass-to-charge ratio order (as in the FIG. 5 embodiment).

By changing one or more fundamental trapping field signal parameters (i.e., by changing one or more of the frequency or amplitude of the AC component of the fundamental voltage signal, or the amplitude of the DC component of the fundamental voltage), a mass selective instability scan can be performed during period B to eject different trapped ions sequentially.

During period A or period B (or both) of the FIG. 5 embodiment, a supplemental AC voltage (having frequency different than that of the RF component of the fundamental voltage) can be applied together with the fundamental voltage signal. In this case, during period B, the combined field parameters can be changed by changing one or more of the frequency or amplitude of the AC component of the fundamental voltage or supplemental AC voltage, or the amplitude of the DC component of the fundamental voltage.

In variations on the embodiments of FIG. 2 or FIG. 5, after period A, at least one high power supplemental AC voltage signal (having "high" power in the sense that its amplitude is sufficiently large to resonate a selected ion to a degree enabling detection of the ion) is applied to the trap electrodes, and at least one low power supplemental AC voltage signal (having "low" power in the sense that its amplitude is sufficient to induce dissociation of a selected ion, but insufficient to resonate the ion to a degree enabling it to be detected) is also applied to the trap electrodes. The frequency of each supplemental AC voltage signal is selected to match a resonance frequency of an ion having a desired mass-to-charge ratio. Each low power supplemental voltage signal is applied for the purpose of dissociating specific ions (i.e., parent ions) within the trap, and each high power supplemental voltage signal is applied to resonate products of the dissociation process (i.e., daughter ions) for detection.

In other variations on the embodiments of FIG. 2 or FIG. 5, collision gas is introduced into the trap region during period A, to improve the mass resolution and/or sensitivity of the mass analysis operation performed during period B, or the storage efficiency. The collision gas will typically be introduced at a pressure in the range from about 0.00001 torr to 0.01 torr (or even greater pressure).

Various other modifications and variations of the described method of the invention will be apparent to those skilled in the art without departing from the scope and spirit of the invention. Although the invention has been described in connection with specific preferred embodiments, it should be understood that the invention as claimed should not be unduly limited to such specific embodiments.

What is claimed is:

1. A mass spectrometry method, including the steps of:

(a) introducing ions in a trapping region defined by a set of electrodes, while applying a combined signal to at least a subset of the electrodes thereby establishing a combined field capable of trapping one or more selected ones of the ions in the trapping region, and ejecting ions other than said selected ones of the ions from the trapping region, wherein the combined signal comprises a trapping voltage signal and a filtered noise signal; and (b) after step (a), changing one or more parameters of the combined signal to sequentially excite the selected ones of the ions for detection.

2. The method of claim 1, wherein the trapping voltage signal establishes a three-dimensional quadrupole trapping field in the trapping region.

3. The method of claim 2, wherein step (b) includes the step of:

changing an amplitude and/or frequency of a component of the trapping voltage signal.

4. The method of claim 3, wherein the trapping voltage signal has a radio frequency component, and step (b) includes the step of changing an amplitude and/or frequency of said radio frequency component.

5. The method of claim 3, wherein the trapping voltage signal has a radio frequency component and a DC component, and step (b) includes the step of changing an amplitude of said DC component.

6. The method of claim 1, wherein step (b) includes the step of resonating said selected ones of the ions to a degree sufficient for in-trap detection by an in-trap detector.

7. The method of claim 1, wherein step (b) includes the step of exciting said selected ones of the ions to a degree sufficient for ejection from the trapping region for detection outside the trapping region.

8. The method of claim 1, wherein the filtered noise signal has a single notch.

9. The method of claim 8, wherein the notch has a frequency bandwidth substantially equal to one kilohertz.

10. The method of claim 8, wherein the notch has a frequency bandwidth substantially greater than fifteen kilohertz.

11. The method of claim 10, wherein the notch has a frequency bandwidth substantially equal to 225 kilohertz.

12. The method of claim 1, wherein the electrodes include a ring electrode and a pair of end electrodes, wherein the filtered noise signal has frequency components in a range from about 10 kilohertz to about 175 kilohertz, and wherein the filtered noise signal is applied to the ring electrode to resonate the ions other than said selected ones of the ions out of the trapping region in radial directions toward the ring electrode.

13. The method of claim 1, wherein the electrodes include a ring electrode and a pair of end electrodes, wherein the filtered noise signal has frequency components in a range from about 10 kilohertz to about 500 kilohertz, and wherein the filtered noise signal is applied to the end electrodes.

14. The method of claim 1, wherein the trapping voltage signal establishes a hexapole trapping field in the trapping region.

15. The method of claim 1, wherein the trapping voltage signal establishes an octapole trapping field in the trapping region.

16. The method of claim 1, wherein step (b) includes the step of performing a mass selective instability scan to sequentially excite said selected ones of the ions for detection.

17. The method of claim 1, wherein step (b) includes the step of changing one or more parameters of the trapping voltage signal to sequentially excite said selected ones of the ions for detection.

18. The method of claim 1, wherein step (b) includes the step of changing one or more parameters of the filtered noise signal to sequentially excite said selected ones of the ions for detection.

19. The method of claim 1, wherein step (b) includes the step of detecting said selected ones of the ions using an in-situ detector.

20. The method of claim 1, wherein step (a) includes the step of introducing collision gas into the trap region in such a manner as to improve mass resolution and/or sensitivity during step (b).

21. The method of claim 1, wherein step (a) includes the step of introducing collision gas into the trap region in such a manner as to improve ion storage efficiency.

22. A mass spectrometry method, including the steps of:

(a) introducing ions in a trapping region bounded by a ring electrode and a pair of end electrodes separated along a central axis, while applying a combined signal to at least a subset of the ring electrode and the end electrodes to establish a combined trapping field in said trapping region, wherein the combined trapping field includes a three-dimensional guadrupole trapping field component, wherein the combined trapping field is capable of trapping one or more selected ones of the ions in the trapping region and ejecting ions other than said selected ones of the ions from the trapping region, and wherein the combined signal comprises a fundamental trapping voltage signal and a filtered noise signal; and (b) after step (a), changing one or more parameters of the combined signal to sequentially excite the selected ones of the ions for the detection.

23. The method of claim 22, wherein the combined signal also includes a supplemental AC voltage signal.

24. The method of claim 22, wherein step (b) includes the step of:

changing an amplitude of a component of the fundamental trapping voltage signal.

25. The method of claim 24, wherein the fundamental trapping voltage signal has a radio frequency component, and step (b) includes the step of changing an amplitude and/or frequency of said radio frequency component.

26. The method of claim 22, wherein the fundamental trapping voltage signal has a radio frequency component and a DC component, and step (b) includes the step of changing an amplitude and/or frequency of said DC component.

27. The method of claim 22, wherein step (b) includes the step of resonating said selected ones of the ions to a degree sufficient for in-trap detection by an in-trap detector.

28. The method of claim 22, wherein step (b) includes the step of exciting said selected ones of the ions to a degree sufficient for ejection from the region for detection outside said region.

29. The method of claim 22, wherein the filtered noise signal has a single notch.

30. The method of claim 29, wherein the notch has a frequency bandwidth substantially equal to one kilohertz.

31. The method of claim 29, wherein the notch has a frequency bandwidth substantially greater than fifteen kilohertz.

32. The method of claim 22, wherein the filtered noise signal has frequency components in a range from about 10 kilohertz to about 175 kilohertz, and wherein the filtered noise signal is applied to the ring electrode to resonate the ions other than said selected ones of the ions out of the region in radial directions toward the ring electrode.

33. The method of claim 22, wherein the filtered noise signal has frequency components in a range from about 10 kilohertz to about 500 kilohertz, and wherein the filtered noise signal is applied to the end electrodes.

34. A mass spectrometry method, including the steps of:

(a) introducing ions in a trapping region defined by a set of electrodes, while applying a combined signal to the electrodes thereby establishing a combined field capable of trapping one or more selected ones of the ions in the trapping region and ejecting ions other than said one or more selected ones of the ions from the trapping region, wherein the combined signal comprises a trapping voltage signal and a filtered noise signal; and (b) after step (a), terminating application of the filtered noise signal, and changing one or more parameters of the trapping voltage signal to sequentially excite the selected ones of the ions for detection.

35. The method of claim 34, wherein the trapping voltage signal establishes a three-dimensional quadrupole trapping field in the trapping region during step (b).

36. The method of claim 34, wherein step (b) includes the step of performing a mass selective instability scan to sequentially excite said selected ones of the ions for detection.

37. The method of claim 34, wherein the trapping voltage signal has a radio frequency component and a DC component, and step (b) includes the step of changing an amplitude of said DC component.

38. The method of claim 34, wherein the combined field is capable of trapping parent ions and daughter ions, and wherein step (b) includes the steps of:

(c) applying a low power supplemental AC voltage signal to the electrodes to induce dissociation of a first trapped parent ion, wherein the low power supplemental AC voltage signal has a first frequency matching a resonant frequency of the first trapped parent ion;

(d) after step (c), applying a high power supplemental AC voltage signal to the electrodes to resonate a first daughter ion to a degree sufficient to enable detection of the first daughter ion, wherein the high power supplemental AC voltage signal has a second frequency matching a resonant frequency of the first daughter ion; and (e) after step (d), applying a second low power supplemental AC voltage signal to the electrodes to induce dissociation of a second trapped parent ion, wherein the second low power supplemental AC voltage signal has a third frequency matching a resonant frequency of the second trapped parent ion; and (f) after step (e), applying a second high power supplemental AC voltage signal to the electrodes to resonate a second daughter ion to a degree sufficient to enable detection of the second daughter ion, wherein the second high power supplemental AC voltage signal has a fourth frequency matching a resonant frequency of the second daughter ion.

39. The method of claim 34, wherein the combined field is capable of trapping parent ions and daughter ions, and wherein step (b) includes the steps of:

applying a high power supplemental AC voltage signal to the electrodes to resonate first ions having a first mass-to-charge ratio to a degree sufficient to enable detection of said first ions;

then, applying a low power supplemental AC voltage signal to the electrodes to induce dissociation of first parent ions to produce first daughter ions, wherein the low power supplemental AC voltage signal has a first frequency matching a resonant frequency of the first parent ions, and wherein the first daughter ions have the first mass-to-charge ratio; and then, applying a second high power supplemental AC voltage signal to the electrodes to resonate the first daughter ions to a degree sufficient to enable detection of the first daughter ions, wherein the second high power supplemental AC voltage signal has a second frequency matching a resonant frequency of the first daughter ions.

40. The method of claim 39, wherein the first parent ion has molecular weight equal to P, and wherein the first ions and the first daughter ions have molecular weight equal to P-N, where N is a neutral loss mass.

* * * * *